US006811451B2

(12) United States Patent
Mase et al.

(10) Patent No.: US 6,811,451 B2
(45) Date of Patent: Nov. 2, 2004

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/175,243

(22) Filed: Jun. 18, 2002

(65) Prior Publication Data

US 2002/0193013 A1 Dec. 19, 2002

(30) Foreign Application Priority Data

Jun. 18, 2001 (JP) ..... 2001-183995

(51) Int. Cl.[7] ..... H01R 13/434
(52) U.S. Cl. ..... 439/752; 439/595
(58) Field of Search ..... 439/52, 595, 744, 439/745, 752.5

(56) References Cited

U.S. PATENT DOCUMENTS 5,474,477 A * 12/1995 Aoyama ..... 439/752
5,738,551 A * 4/1998 Matsuoka ..... 439/752
5,830,013 A * 11/1998 Saito et al. ..... 439/595
6,036,552 A * 3/2000 Atsumi ..... 439/752
6,139,375 A * 10/2000 Konoya et al. ..... 439/752
2001/0027067 A1 * 10/2001 Kojima et al. ..... 439/752

FOREIGN PATENT DOCUMENTS

JP 5-144499 6/1993

* cited by examiner

*Primary Examiner*—Hien D. Vu
(74) *Attorney, Agent, or Firm*—Gerald E. Hespos; Anthony J. Casella

(57) ABSTRACT

A connector includes a housing (10) and a retainer (40) that can be moved from a partial locking position to a full locking position in the housing (10). Terminal fittings (30) can be inserted into the housing (10) when the retainer (40) is at the partial locking position. However, the retainer (40) locks the terminal fittings (30) when the retainer is moved to the full locking position. Pairs of partial locks (50° F., 50 R) prevent the retainer (40) from moving loosely from the partial locking position toward the full locking position. Pairs of full locks (51° F., 51 R) prevent the retainer (40) from moving loosely from the full locking position toward the partial locking position.

11 Claims, 7 Drawing Sheets

CONNECTOR

BACKGROUND OF THE INVENTION

1. Field of the Invention

The invention relates to a connector with at least one terminal fitting locked in a housing by a retainer.

2. Description of the Related Art

Japanese Unexamined Patent Publication No. 5-144499 discloses a connector with terminal fittings locked in a housing by a retainer. The retainer can be moved normal to an inserting direction of the terminal fittings between a partial locking position and a full locking position. The retainer is retracted from insertion paths of the terminal fittings when the retainer is at the partial locking position. However, the retainer enters the insertion paths when the retainer is moved to the full locking position. The retainer is mounted at the partial locking position before the terminal fittings are inserted into the housing. Thus, the terminal fittings can be inserted without any problem. The retainer then is moved to the full locking position and locks the terminal fittings in the housing.

Insertion of the terminal fittings is hindered if the retainer is moved inadvertently to the full locking position. Thus, the connector of JP 5-144499 has a partial locking means for preventing the retainer from moving from the partial locking position to the full locking position. Further, the terminal locking function is lost if the retainer is moved from the full locking position back to the partial locking position. Thus, a full locking means is provided to prevent the retainer from moving from the full locking position to the partial locking position.

The invention was developed in view of the above problem, and an object thereof is to provide reliable partial and full of locking the retainer.

SUMMARY OF THE INVENTION

The invention relates to a connector with a housing and terminal fittings inserted into the housing. A retainer is assembled with the housing for displacement between a partial locking position and a full locking position. The terminal fittings can be inserted into the housing when the retainer is at the partial locking position. However, the retainer locks the terminal fittings when the retainer is at the full locking position. The retainer has at least one pair of partial locking means for engaging partial lock receiving portions of the housing to prevent the retainer from moving loosely from the partial locking position toward the full locking position. The retainer also has at least one pair of full locking means for engaging full lock receiving portions of the housing to prevent the retainer at the full locking position from moving loosely toward the partial locking position. At least one of the partial locking means and the full locking means define two or more pairs. Thus, a partial locking function or a full locking function can be effected more reliably as compared to connectors with only one pair of partial locking means or full locking means.

The paired partial locking means preferably are at opposite ends of the retainer with respect to a direction normal to a terminal inserting direction.

At least one of the partial locking means and the full locking means preferably is provided at a plurality of positions spaced part in a direction substantially parallel with the terminal inserting direction, but located substantially at the same position with respect to a displacing direction of the retainer. Thus, the retainer can be oriented stably, and there is no possibility that the retainer is inclined with respect to the terminal inserting direction.

Locking projections of the retainer may serve both as the partial locking means and as the full locking means. Thus, the retainer can have a simple shape as compared to retainers with separate partial and full locks.

Receiving projections of the housing may serve both as the partial and full locking means. Thus, the housing can have a simple shape as compared to retainers with separate receiving portions for partial and full locking.

The terminal fittings preferably are locked in the housing by resilient locks that allow the terminal fittings to move loosely along the terminal insertion direction when the retainer is in the partial locking position. However, the retainer prevents loose movement of the terminal fittings wherein the retainer is in the full locking position.

The retainer may have a pusher for pushing the terminal fitting toward a proper position when the retainer is moved toward the full locking position.

The retainer preferably can make loose movements substantially along the terminal insertion direction with respect to the housing when the retainer is in the partial locking position. However, the retainer is substantially prevented from making loose movements when arranged in the full locking position.

The retainer may have engaging portions for engaging the housing when the retainer is in the full locking position to prevent the retainer from moving loosely.

These and other objects, features and advantages of the invention will become more apparent upon reading the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

A connector of this embodiment is provided with a housing 10 made e.g. of a synthetic resin, a front-stop member 14 e.g. made of a synthetic resin, a plurality of terminal fittings 30, and a retainer 40 e.g. of a synthetic resin. In the following, a mating side of the connector with a mating connector (not shown) is referred to as the front side.

Figure 6:
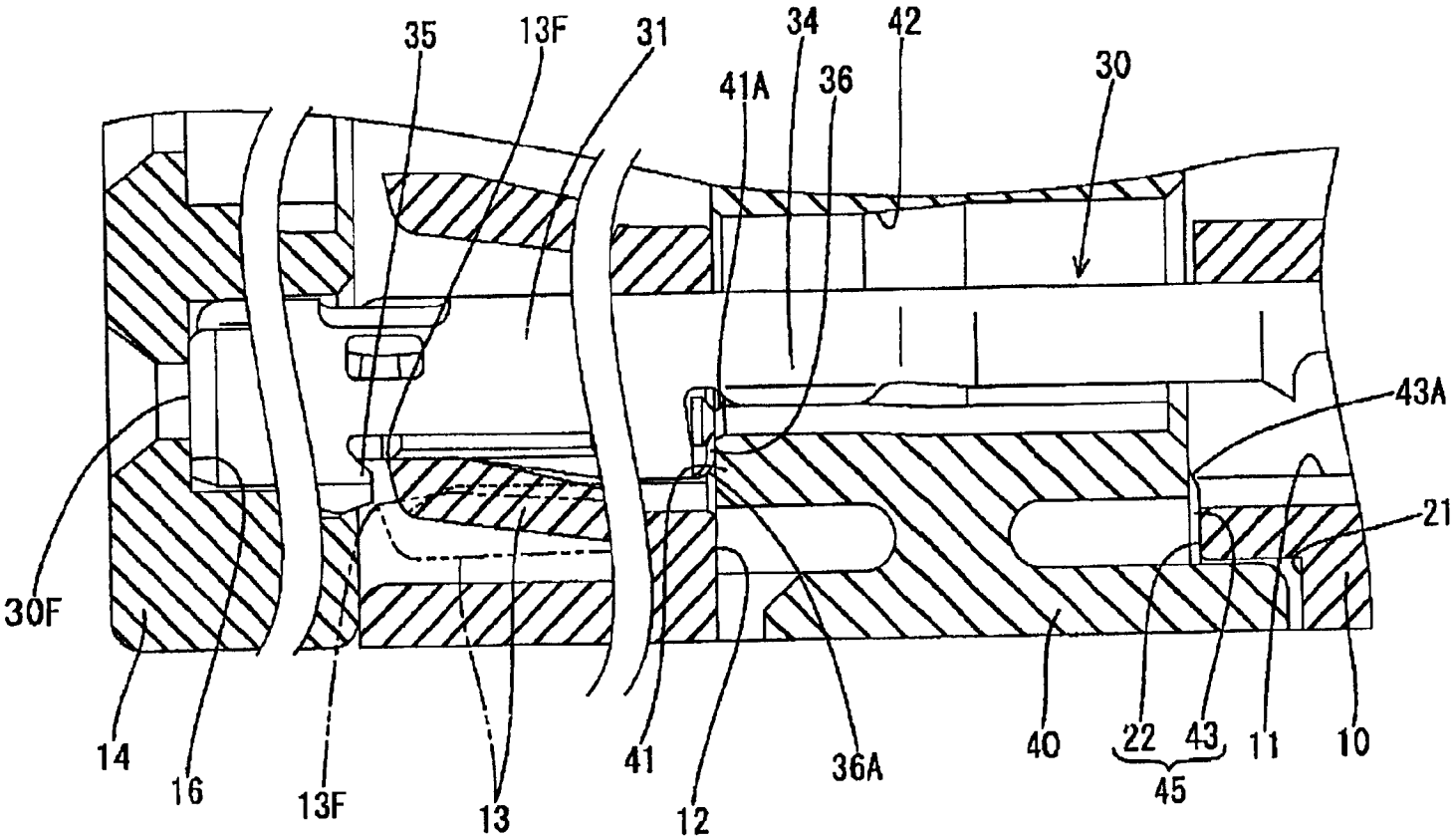
FIG. 6 is a fragmentary enlarged section partly cut away showing a state where the retainer is located at the full locking position.
Figure 7:
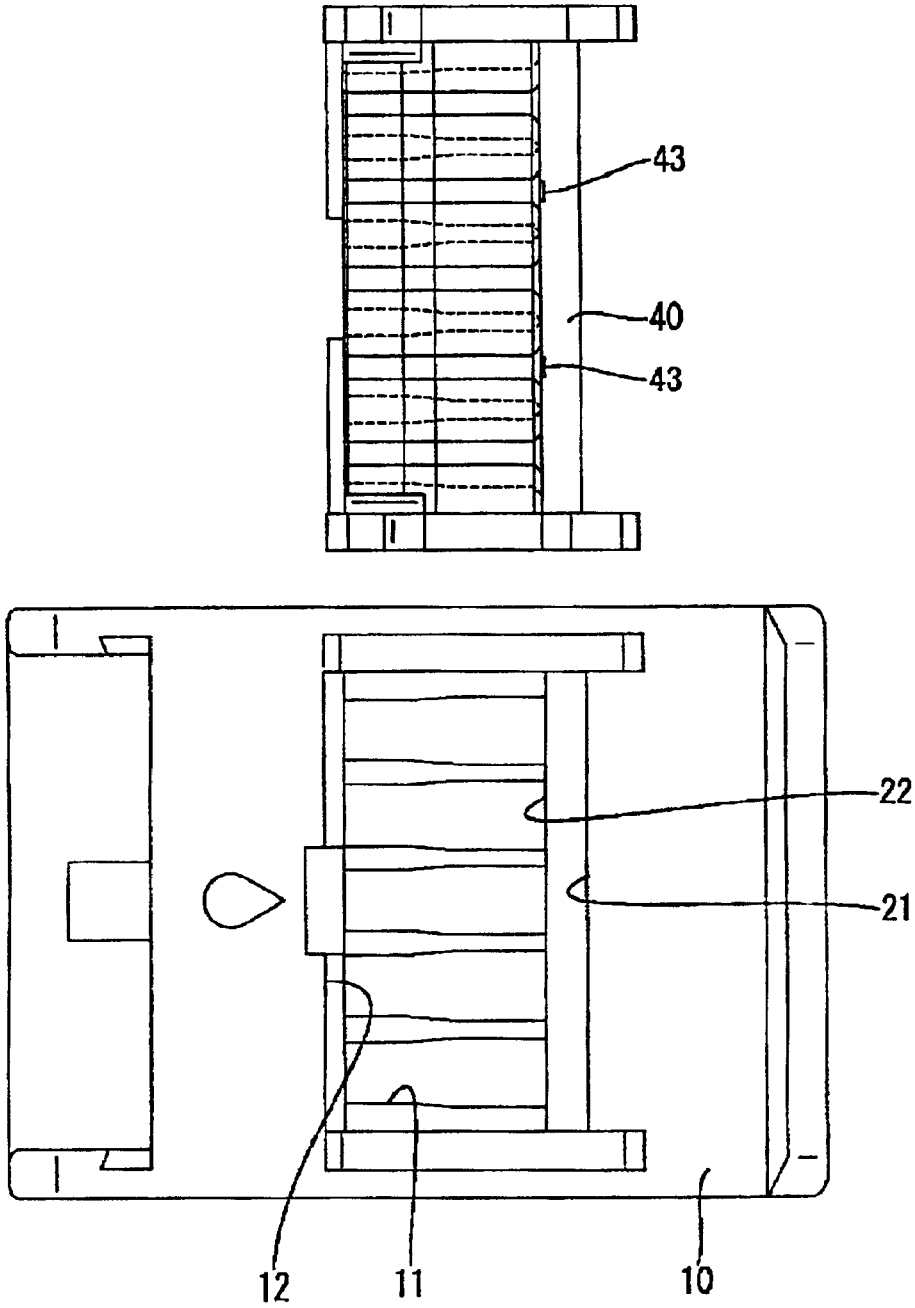
FIG. 7 is a bottom view showing a state where the retainer is detached from and arranged beside the housing.

The housing 10 has cavities 11 arrayed transversely at upper and lower stages and a retainer accommodating chamber 12 opens in the bottom surface of the housing 10 for communication with the cavities 11. A resiliently deformable lock 13 cantilevers forward from a position on the bottom wall of each cavity 11 before the retainer accommodating chamber 12. The lock 13 normally is at a locking position (see FIG. 1) where a front end 13F of the lock 13 is in the cavity 11. However, the lock 13 can be deformed about its rear end from the locking position to a retracted position (shown in chain line in FIG. 6) so that the front end 13F of the lock 13 is displaced obliquely forward and down in a direction DD while describing an arcuate trace. Thus, the front end 13F of the lock 13 moves toward the front of the housing 10 as the lock 13 is deformed into the retracted position.

The front-stop member 14 is mounted at the front end of the housing 10 and is formed with recesses 15 that communicate with the front ends of the cavities 11. Front ends of properly inserted terminal fittings 30 are accommodated in the recesses 15. The front stop member 14 has front-stop surfaces 16 at the front ends of the respective recesses 15 to define front limit positions for the terminal fittings 30.

Two slit-shaped locking spaces 17 are formed at the opposite transverse ends of the retainer accommodating chamber 12 and are open in the bottom surface of the housing 10. Receiving projections 18F, 18R are formed respectively on the front and rear walls of the retainer accommodating chamber 12 and align with the locking spaces 17. The respective receiving projections 18F, 18R include downwardly facing partial locking receiving surfaces 19F, 19R that are oblique to both the vertical direction and forward and backward directions. The respective receiving projections 18F, 18R also include upwardly facing full locking receiving surfaces 20F, 20R that are substantially normal to the vertical moving direction MD of the retainer 40 and substantially parallel to the inserting direction ID of the terminal fittings 30. The receiving projections 18F, 18R are at substantially at the same height along vertical moving direction MD of the retainer 40. However, the front receiving projection 18F may be slightly higher than the rear receiving projection 18R.

Each terminal fitting 30 is narrow and long in forward and backward directions and is formed by bending a metallic material e.g. stamped out into a specified shape. A box 31 is formed at the front of the terminal fitting 30 and is configured to connect with an unillustrated mating terminal. A wire-connecting portion 33 is defined at the rear of the terminal fitting 30 and is configured for crimped connection with a wire 32. A coupling portion 34 extends between the box 31 and the wire connecting portion 33. The bottom of the box 31 includes a first engaging hole 35 that is configured for engagement with the lock 13. The rear end of the box 31 defines a pushable portion 36 for engaging the retainer 40. A slanted contact portion 36A is defined at the bottom of the pushable portion 36.

Figure 1:
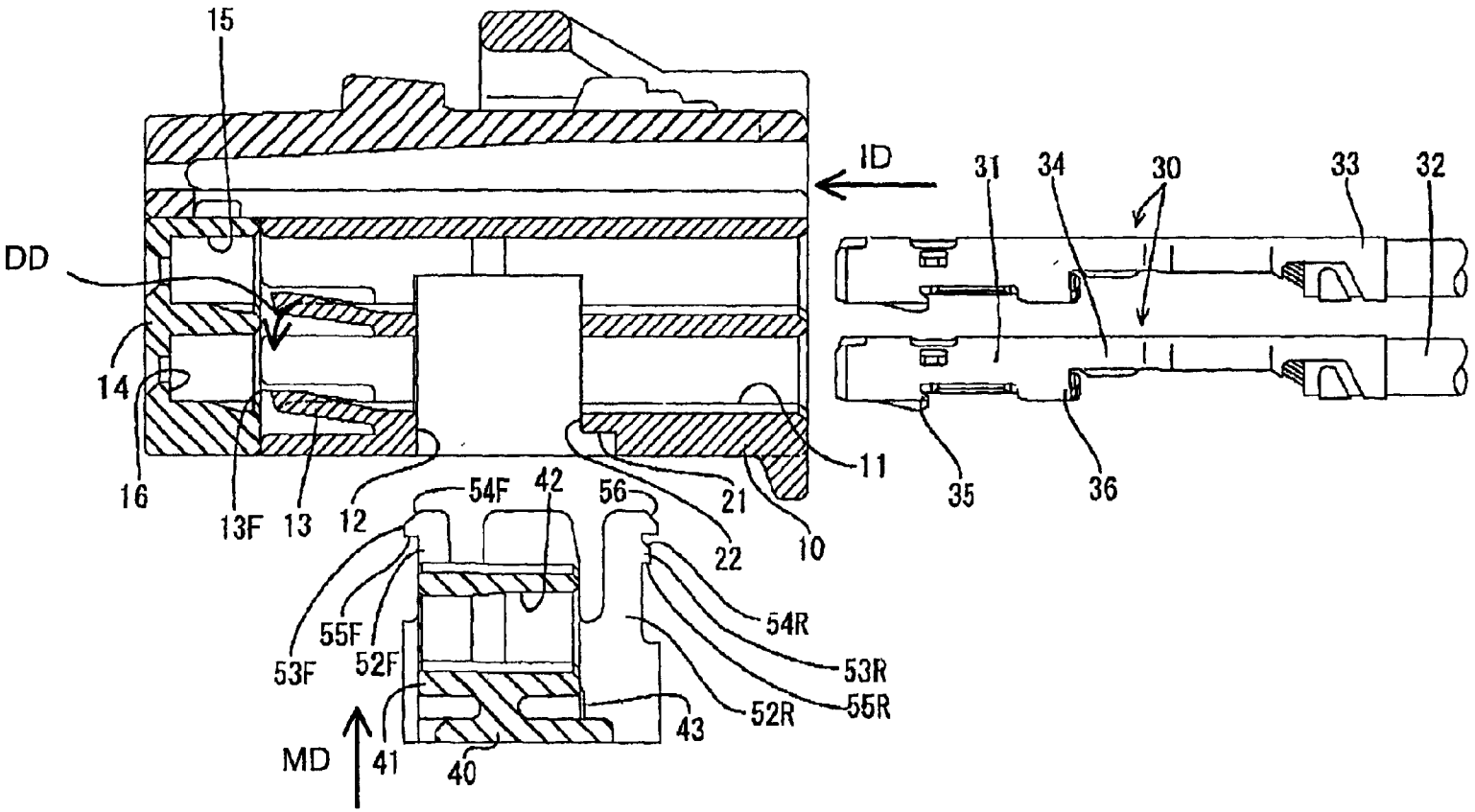
FIG. 1 is a section showing a state where terminal fittings and a retainer are detached from a housing.

A distance between the front end 30F of the terminal fitting 30 and the first engaging portion 35 in forward and backward directions or along the inserting direction ID is slightly shorter than a distance between the front-stop surface 16 and the front end 13F of the lock 13 when the lock 13 is at the locking position. Thus, when the front end 30F of the terminal fitting 30 contacts the front-stop surface 16, the lock 13 can be restored resiliently from the retracted position substantially to the locking position (FIG. 1). Additionally, the above-referenced relative dimensions enable the properly inserted terminal fitting 30 to make slight loose shaking movements along forward and backward directions between the proper insertion position, where the front end surface 30F contacts the front-stop surface 16, and the locking position, where the first engaging portion 35 contacts the front end 13F of the lock 13.

The retainer 40 is adapted to hold the terminal fittings 30 inserted into the housing 10. Pushers 41 are formed at the upper front surface of the retainer 40 and correspond to the cavities 11 at the upper stage. The retainer 40 also has through holes 42 that correspond to the respective cavities 11 at the lower stage, and the bottom front edges of the through holes 42 define pushers 41 that correspond to the cavities 11 at the lower stage. Slanted contacts 41A are formed on the pushers 41 and are oblique both to the vertical moving direction MD and the forward and backward inserting direction ID.

Left and right vertical ribs 43 are formed on the rear of the retainer 40. On the other hand, an escaping recess 21 is formed in an area of the rear wall of the retainer accommodating chamber 12 adjacent the bottom opening for avoiding interference with the ribs 43 when the retainer 40 is at a partial locking position (see FIGS. 2, 5). With the retainer 40 at the partial locking position, the ribs 43 of the retainer 40 face the escaping recess 21 and are at the same height. Further, an area of the rear wall of the retainer accommodating chamber 12 above the escaping recess 21 and below the cavities 11 of the lower stage defines a rib receiving surface 22, and the ribs 43 face the rib receiving surface 22 at the same height when the retainer 40 is at a full locking position (see FIGS. 3, 6). A dimension between the front wall of the retainer accommodating chamber 12 and the rib receiving surface 22 substantially equals the thickness of the retainer 40 including the ribs 43 along forward and backward directions. Thus, the retainer 40 can make relatively loose movements forward and backward in the inserting direction ID with respect to the housing 10 while the retainer 40 is at the partial locking position. However, the retainer 40 is prevented from making loose movements in forward and backward directions with respect to the housing 10 while at the full locking position. The ribs 43 of the retainer 40 and the rib receiving surface 22 of the housing 10 form a displacing means 45 for displacing the retainer 40 forward with respect to the housing 10 while the retainer 40 is being moved from the partial locking position to the full locking position.

The housing 10 and the retainer 40 both have two pairs of partial locking means 50F, 50R and two pairs of full locking means 51F, 51R which are arranged at the opposite transverse ends of the retainer 40. These partial and full locking means are described in detail below.

A pair of upwardly-projecting cantilever-shaped resilient locking pieces 52F, 52R are formed at each of the opposite ends of the retainer 40 and spaced apart in forward and backward directions. A locking projection 53F is formed at the upper projecting end of each front resilient locking piece 52F and projects forward. A partial locking surface 54F is formed at the top of each locking projection 53F and extends oblique to the moving direction MD of the retainer 40 between the partial locking position and the full locking position. A full locking surface 55F is formed at the bottom of each locking projection 53F and is substantially normal to the moving direction MD of the retainer 40. On the other hand, a partial locking projection 56 projects back from the upper end of the rear resilient locking piece 52R, and a locking projection 53R projects back from a location below the partial locking projection 56. A partial locking surface 54R is formed at the top of each locking projection 53R and extends oblique to the moving direction MD of the retainer 40 between the partial locking position and the full locking position. A full locking surface 55R is formed at the bottom of each locking projection 53R and extends substantially normal to the moving direction MD of the retainer 40. The front locking projections 53F and the rear locking projections 53R are at substantially the same height along the moving direction MD. However, the front locking projections 53F may be slightly higher than the rear locking projections 53R.

The locking projections 53F, 53R of the retainer 40 and the receiving projections 18F, 18R of the housing 10 form the partial locking means 50F, 50R for preventing the retainer 40 at the partial locking position from moving loosely toward the full locking position, and the full locking means 51F, 51R for preventing the retainer 40 at the full locking position from moving loosely toward the partial locking position.

Figure 2:
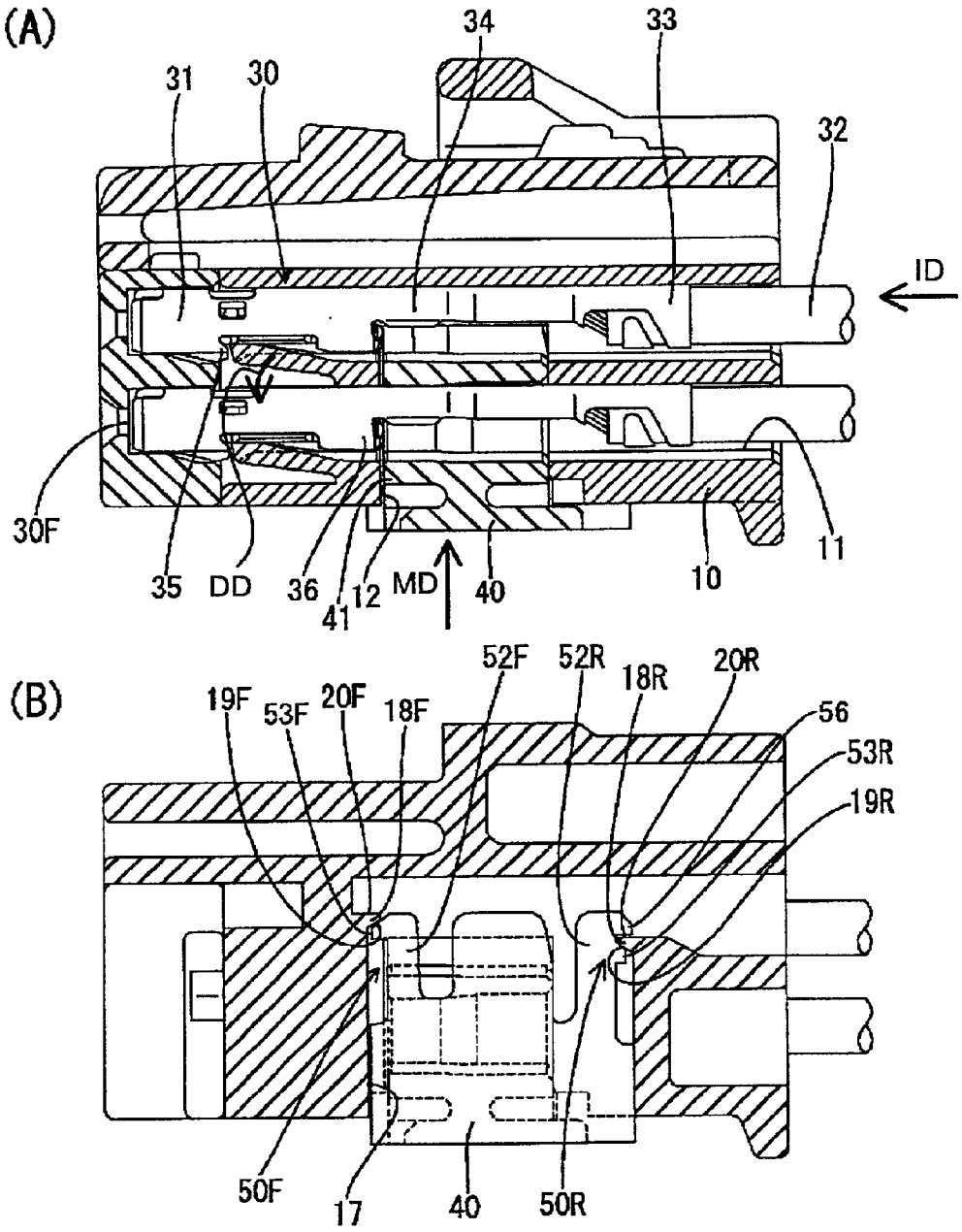
FIG. 2A is a section showing a state where insertion of the terminal fittings is permitted with the retainer at a partial locking position.
FIG. 2B is a section showing a state where the retainer is at the partial locking position.
Figure 3:
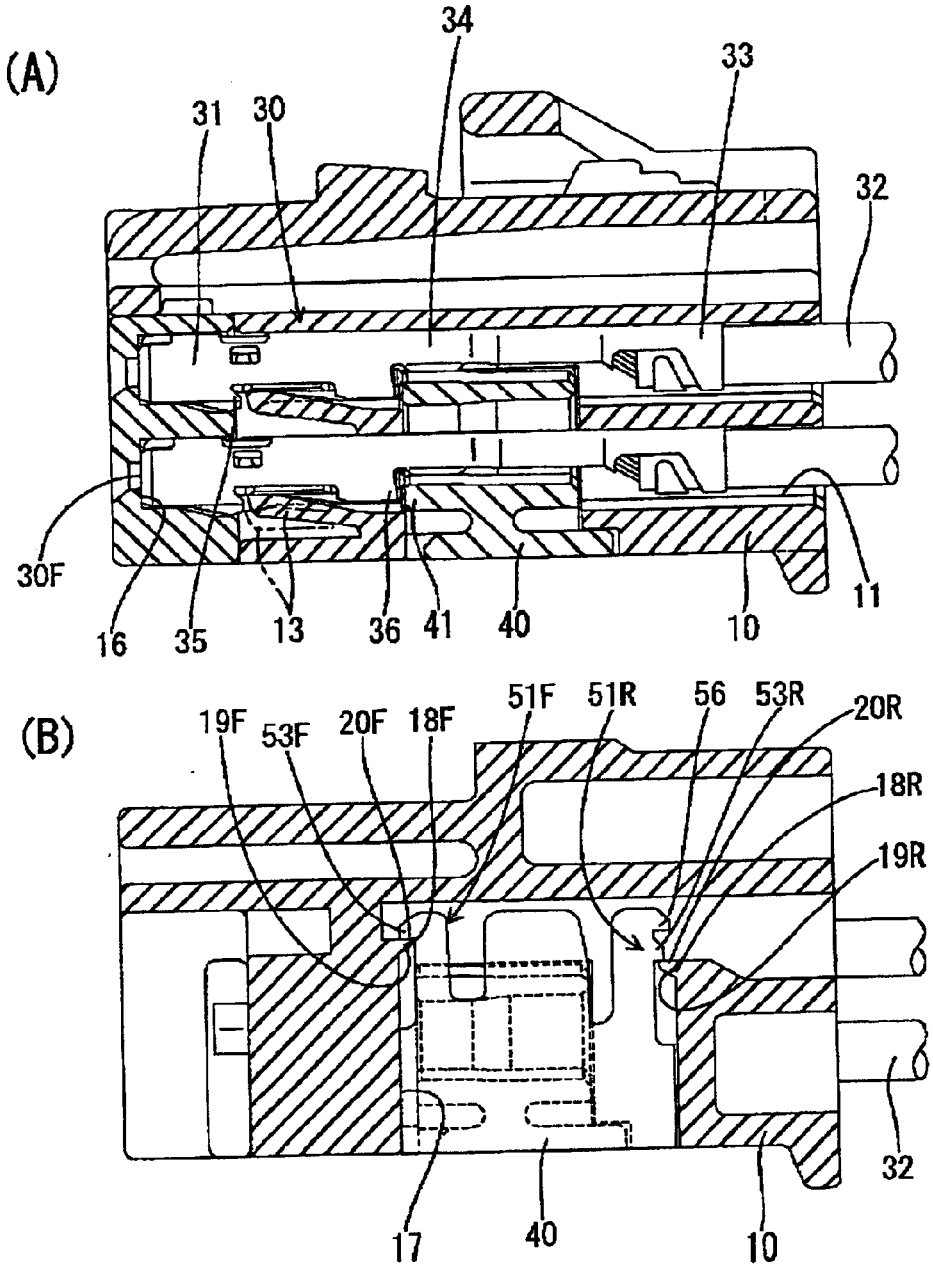
FIG. 3A is a section showing a state where the terminal fittings are locked by the retainer at a full locking position.
FIG. 3B is a section showing a state where the retainer is at the full locking position.
Figure 4:
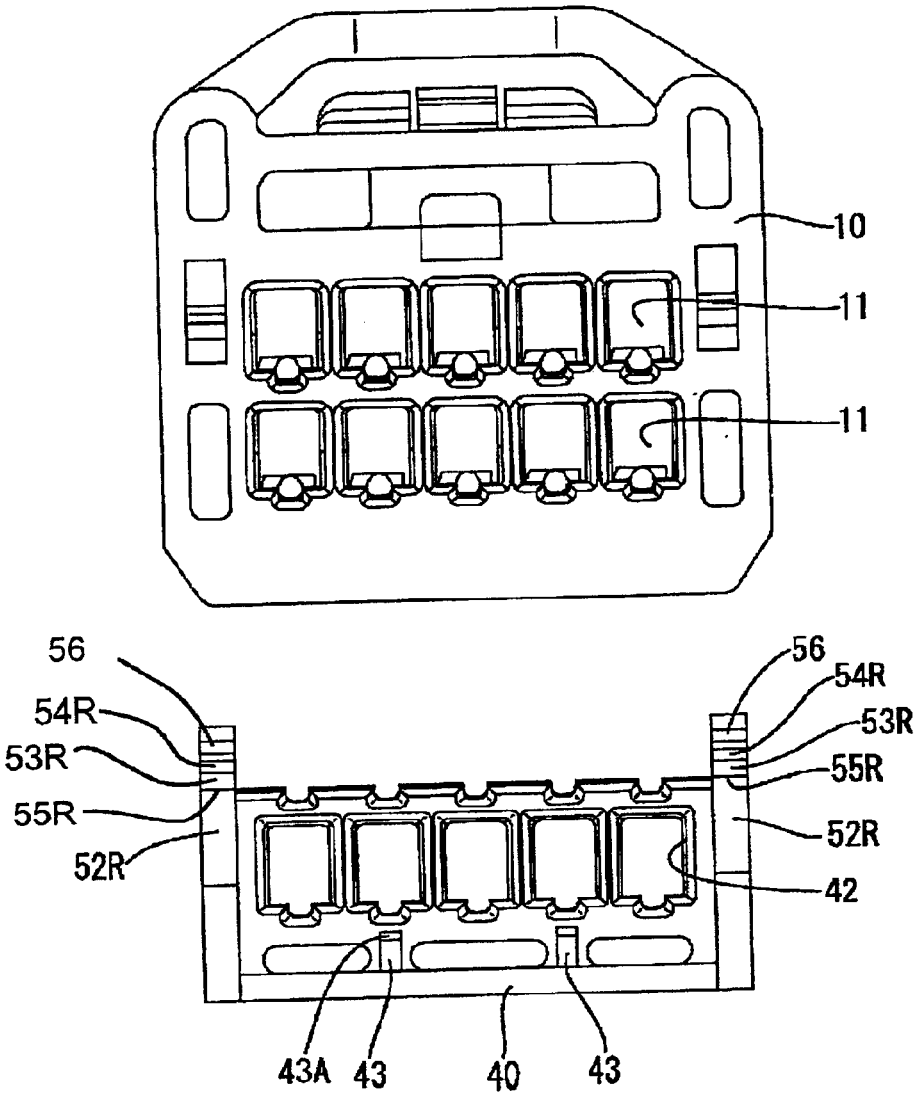
FIG. 4 is a rear view the retainer detached from the housing.
Figure 5:
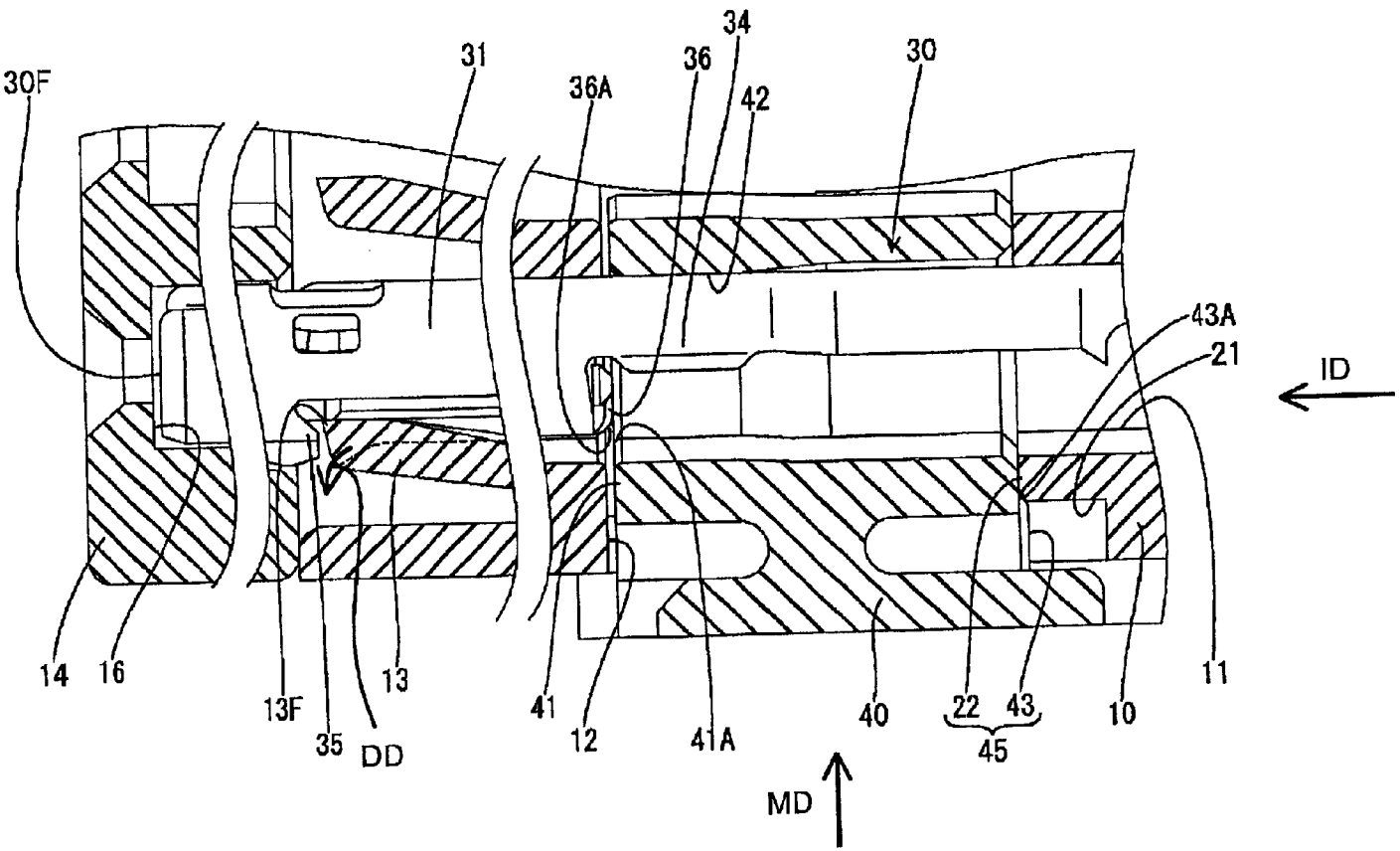
FIG. 5 is a fragmentary enlarged section partly cut away showing a state where the retainer is located at the partial locking position.

The retainer 40 is mounted at the partial locking position in the housing 10 before the terminal fittings 30 are inserted into the housing 10 (see FIGS. 2 and 5). The two pairs of the front and rear locking projections 53F, 53R and two pairs of the front and rear partial locking surfaces 54F, 54R of the retainer 40 substantially contact the receiving surfaces 19F, 19R of the partial locking receiving projections 18F, 18R of the housing 10 from below in this state. Thus, the retainer 40 is prevented from moving loosely up toward the full locking position. Further, the partial locking projections 56 contact the full locking receiving surfaces 20R of the rear receiving projections 18R from above. Thus, the retainer 40 also is prevented from moving down and out of the housing 10. Further, the pushers 41 of the retainer 40 are retracted down and away from the insertion paths of the terminal fittings 30.

The terminal fitting 30 is inserted in the inserting direction ID into the corresponding cavity 11 from behind in this state. Forces exerted by the bottom surface of the box 31 of the terminal fitting 30 during the insertion deform the lock 13 down in the deformation direction DD to the retracted position. The terminal fitting 30 reaches its proper insertion position with the front end 30F substantially contacting the front-stop surface 16. The front end 13F of the lock 13 then is free from the bottom surface of the box 31, and the lock 13 is restored resiliently toward the locking position. The front end 13F of the lock 13 reaches a height substantially corresponding to the first engaging portion 35 of the terminal fitting 30. However, the front end 13F of the lock 13 is displaced back during the movement of the lock 13 from the retracted position to the locking position. Thus, a clearance is formed between the front end 13F of the lock 13 and the first engaging portion 35 in forward and backward directions (see FIG. 6), and the terminal fitting 30 is likely to shake forward and backward along the insertion direction ID.

The retainer 40 next is moved in the direction MD from the partial locking position (FIGS. 2, 5) to the full locking position (FIGS. 3, 6) by deforming the resilient locking pieces 52F, 52R to disengage the partial locking surfaces 54F, 54R from the partial locking receiving surfaces 19F, 19R. The locking projections 53F, 53R then move beyond the receiving projections 18F, 18R, and two pairs of front and rear full locking surfaces 55F, 55R engage the full locking receiving surfaces 20F, 20R from above. As a result, the retainer 40 is held at the full locking position and will not return to the partial locking position.

Movement of the retainer 40 from the partial locking position to the full locking position moves the ribs 43 to a height corresponding to the rib receiving surface 22. Thus, if the retainer 40 is at its rearmost position with the ribs 43 in the escaping recess 21, the retainer 40 is displaced forward by engagement of the ribs 43 and the rib receiving surface 22. The upper ends of the ribs 43 define the slanted guide surfaces 43A that move the ribs 43 smoothly to an engaging height with the rib receiving surface 22.

Further, if the terminal fittings 30 are at their proper insertion positions when the retainer 40 is moved to the full locking position (see FIG. 6), the pushers 41 slide in contact with the pushable portions 36 from behind without moving the terminal fittings 30 forward in the insertion direction ID since the rear surfaces of the pushable portions 36 of the terminal fittings 30 and the front surfaces of the pushing portions 41 of the retainer are at substantially the same position with respect to forward and backward directions. As a result, the retainer 40 holds the terminal fittings 30 at their proper insertion positions.

If the terminal fitting 30 is behind the proper insertion position (see FIG. 5), the front surfaces of the pushers 41 try to be located before the rear surfaces of the pushable portions 36 as the retainer 40 is displaced forward by the engagement of the ribs 43 and the rib receiving surface 22. However, the slanted contact portions 36A, 41A at the bottom ends of the rear surfaces of the pushable portions 36 and at the upper edges of the front surfaces of the pushers 41 obliquely contact each other, and the pushers 41 push the pushable portions 36 forward by the inclination of the contacts 36A, 41A as the retainer 40 is moved. When the retainer 40 reaches the full locking position, the terminal fitting 30 is pushed to the proper insertion position.

The connector of this embodiment has the following effects.

Since two pairs of front and rear partial locking means 50F, 50R are provided, a partial locking function can be effected more reliably as compared to connectors with only one pair of partial locking means. Similarly, since two pairs of front and rear full locking means 51F, 51R are provided, a full locking function can be effected more reliably as compared to connectors with only one pair of full locking means.

Since the partial locking means 50F, 50R are at two positions spaced apart in forward and backward directions, the retainer 40 can be oriented stably at the partial locking position. Further, since the two partial locking means 50F, 50R are at substantially the same position with respect to vertical direction, there is no possibility that the retainer 40 is inclined with respect to forward and backward directions at the partial locking position.

Similarly, since the full locking means 51F, 51R are at two positions spaced apart in forward and backward directions, the retainer 40 can be oriented stably at the full locking position. Further, since the two full locking means 51F, 51R are at substantially the same position with respect to vertical direction position, there is no possibility that the retainer 40 is inclined with respect to forward and backward directions at the full locking position.

Since the locking projections 53F, 53R of the retainer 40 serve both as the partial locking portions and as the full locking portions, the retainer 40 has a simpler shape than those in which partial and full locking portions are separate. Similarly, since the receiving projections 18F, 18R in the housing 10 serve both as the partial locking receiving portions and as the full locking receiving portions, the housing 10 can be designed to have a simpler shape as compared to those in which partial and full locking portions are separate.

The front end 30F of each properly inserted terminal fitting 30 contacts the corresponding front-stop surface 16 and can shake in forward and backward directions between the proper insertion position, where a clearance exists between the first engaging portion 35 and the front end 13F of the lock 13, and the locking position, where the first engaging portion 35 engages the front end 13F of the lock 13. When the retainer 40 is moved from the partial locking position to the full locking position, the terminal fittings 30 are held at their proper insertion positions by the forward displacement of the retainer 40. Thus, the terminal fittings 30 cannot shake when the retainer 40 is at the full locking position. At this time, even if the terminal fitting 30 is behind the proper insertion position when the retainer 40 is moved to the full locking position, it does not hinder the movement of the retainer 40 since the retainer 40 can push the terminal fitting 30 forward due to the slanted contacts 36A, 41A.

The retainer 40 is displaced forward or in the insertion direction ID while being moved in the moving direction MD from the partial locking position to the full locking position. This displacing direction ID increases engaging areas of the front receiving projections 18F and the locking projections 53F. Thus, engaging areas of the full locking receiving surfaces 20 and the full locking surfaces 55F are larger than those of the partial locking receiving surfaces 19F and the partial locking surfaces 54F. Since the large engaged areas of the full locking surfaces 55F and the receiving surfaces 20F can be ensured with the retainer 40 at the full locking position, the retainer 40 can be held highly reliably at the full locking position.

Further, the retainer 40 moved to the full locking position (FIGS. 3, 6) does not shake in forward and backward directions since the ribs 43 contact the rib receiving surfaces 22 and the pushers 41 contact the terminal fittings 30 at their front-limit positions. Therefore, there is no possibility of disengaging the full locking surfaces 55F, 55R from the receiving surfaces 20F, 20R for full locking due to the shaking movement of the retainer 40 in forward and backward directions.

The invention is not limited to the described and illustrated embodiment. For example, the following embodiments are also embraced by the technical scope of the present invention as defined in the claims. Beside the following embodiments, various changes can be made without departing from the scope and spirit of the present invention as defined in the claims.

Although a plurality of pairs of partial locking means and a plurality of pairs of full locking means are provided in the foregoing embodiment, either one of the partial locking means and the full locking means may be one pair and the other thereof may be two or more pairs.

Although two pairs of the partial locking means are provided in the foregoing embodiment, three or more pairs of the partial locking means may be provided.

Although two pairs of full locking means are provided in the foregoing embodiment, three or more pairs of full locking means may be provided.

Although each resiliently locking piece is formed with one partial lock in the foregoing embodiment, it may be formed with plural partial locks.

Although each resiliently locking piece has one full locking portion in the foregoing embodiment, it may be formed with plural full locking portions.

Although the locking portion provided on the resilient locking piece serves both as the partial locking portion and as the full locking portion in the foregoing embodiment, the partial locking portion and the full locking portion may be provided independently.

Although the partial locking portions are provided on the resilient locking pieces formed at the retainer and the receiving portions for partial locking are fixed to the housing in the foregoing embodiment, the partial locking portions may be fixed to the retainer and the receiving portions for partial locking may be provided on the resilient locking pieces formed at the housing.

Although the full locking portions are provided at the resilient locking pieces formed at the retainer and the receiving portions for full locking are fixed to the housing in the foregoing embodiment, the full locking portions may be fixed to the retainer and the receiving portions for full locking may be provided on the resilient locking pieces formed at the housing.

Although the female connector in which the female terminal fittings are accommodated in the housing in the foregoing embodiment, the present invention may be applicable to male connectors in which male terminal fittings having narrow tabs at their front ends are provided in the housing.

One or more than two stages of cavities may be provided.

What is claimed is:

1. An electrical connector, comprising:

a housing having opposite front and rear ends and at least one stage of side by side cavities extending through the housing from the front end to the rear end, a retainer accommodating chamber extending into a lateral surface of the housing between the front and rear ends and communicating with each of said cavities, the retainer accommodating chamber including a rib escaping recess adjacent the lateral surface of the housing into which said retainer accommodating chamber extends, a rib receiving surface being formed in the retainer accommodating chamber at locations adjacent the rib escaping recess, portions of the retainer accommodating chamber adjacent the rib receiving surface defining a smaller front to rear dimension than portions of the retainer accommodating chamber adjacent the rib escaping recess;

terminal fittings insertable into the respective cavities;

a retainer assembled in the retainer accommodating chamber of the housing and displaceable between a partial locking position and a full locking position-, the insertion of the terminal fittings being permitted with the retainer at the partial locking position and the retainer locking the terminal fittings while at the full locking position, the retainer having a plurality of spaced apart one ribs disposed in the rib escaping recess when the retainer is in the partial locking position, each of the ribs being aligned along a retainer insertion direction substantially parallel to a direction of movement of the retainer from the partial locking position to the full locking position, a leading end of the retainer defining a guide surface that is slanted with respect to the retainer insertion direction for guiding the rib into engagement with the rib receiving surface when the retainer is moved to the full locking position;

two pairs of spaced-apart partial locking means for preventing the retainer at the partial locking position from moving loosely toward the full locking position, the partial locking means including partial locks on the retainer for engaging partial locking receiving portions on the housing; and two pairs of spaced-apart full locking means for preventing the retainer at the full locking position from moving loosely toward the partial locking position, the full locking means including full locks on the retainer for engaging full locking receiving portions on the housing, wherein the disposition of the rib in the rib receiving recess permits loose movement of the retainer in front to rear directions when the retainer is in the partial locking position and wherein engagement of the rib with the rib receiving surface prevents loose front to rear movement of the retainer when the retainer is in the full locking position.

2. The connector of claim 1, wherein the pairs of partial locking means are provided respectively at opposite ends of the retainer with respect to a direction substantially normal to a terminal inserting direction.

3. The connector of claim 2, wherein the pairs of full locking means are provided respectively at the opposite ends of the retainer with respect to the direction substantially normal to the terminal inserting direction.

4. The connector of claim 3, wherein at least one of the partial locking means and the full locking means are provided at two positions spaced apart in a direction substantially parallel with the terminal inserting direction.

5. The connector of claim 3, wherein at least one of the partial locking means and the full locking means are provided at a plurality of positions spaced part in a direction substantially parallel with the terminal inserting direction, but located substantially at the same position with respect to a displacing direction of the retainer.

6. The connector of claim 1, wherein locking projections formed at the retainer serve both as the partial locks and as the full locks.

7. The connector of claim 6, wherein receiving projections formed at the housing serve both as the partial locks and as the full locks.

8. The connector of claim 3, wherein the terminal fittings are locked into the housing by resilient locks that allow the terminal fittings to move loosely along the terminal insertion direction when the retainer is in the partial locking position and wherein the retainer in the full locking position prevents the terminal fittings moving loosely along the terminal insertion direction.

9. The connector of claim 3, wherein the retainer includes a pusher for pushing the terminal fitting toward a proper position when the retainer is moved toward the full locking position.

10. The connector of claim 9, wherein each said cavity is configured for insertion of the respective terminal fitting in a rear to front direction, the pusher being disposed on a front portion of the retainer for pushing the respective terminal fittings toward the front end of the housing.

11. The connector of claim 10, wherein the rib is formed on a rear side of the retainer and wherein the rib receiving recess and the rib receiving surface are formed on portions of the retainer accommodating chamber closer to the rear end of the housing.

* * * * *